US005469768A

United States Patent [19]

Schumacher

[11] Patent Number: 5,469,768

[45] Date of Patent: Nov. 28, 1995

[54] MACHINING HEAD FOR A WATER JET CUTTING MACHINE AND AIMING DEVICE INTENDED TO EQUIP SUCH HEAD

[76] Inventor: Charles E. Schumacher, Grand'rue 52, CH-2075 Wavre, Switzerland

[21] Appl. No.: 182,029

[22] PCT Filed: May 27, 1993

[86] PCT No.: PCT/CH93/00138

§ 371 Date: Jan. 27, 1994

§ 102(e) Date: Jan. 27, 1994

[87] PCT Pub. No.: WO92/24277

PCT Pub. Date: Sep. 9, 1993

[30] Foreign Application Priority Data

Jun. 1, 1992 [FR] France ..... 92 06695

[51] Int. Cl.[6] ..... B24C 5/04

[52] U.S. Cl. ..... 83/177; 83/699.51; 83/701

[58] Field of Search ..... 83/177, 53, 701, 83/699.51; 451/102, 40, 442

[56] References Cited

U.S. PATENT DOCUMENTS

| | | | |
|---|---|---|---|
| 4,545,157 | 10/1985 | Saurwein | 451/102 |
| 4,817,874 | 4/1989 | Jarzebowicz | 451/102 |
| 4,832,266 | 5/1989 | Marvin | 239/590.3 |
| 4,836,455 | 6/1989 | Munoz | 239/590.3 |
| 4,854,091 | 8/1989 | Hashish et al. | 451/102 |
| 5,018,670 | 5/1991 | Chalmers | 83/177 |
| 5,092,085 | 3/1992 | Hashish et al. | 451/102 |
| 5,139,202 | 8/1992 | Munoz et al. | 83/177 |
| 5,155,946 | 10/1992 | Domann | 51/410 |
| 5,255,853 | 10/1993 | Munoz | 83/177 |

FOREIGN PATENT DOCUMENTS

| | | |
|---|---|---|
| 0221236 | 5/1987 | European Pat. Off. . |
| 0220374 | 5/1987 | European Pat. Off. . |
| 0230710 | 8/1987 | European Pat. Off. . |
| 4005693 | 8/1991 | Germany . |
| 546625 | 3/1974 | Switzerland . |

*Primary Examiner*—Kenneth E. Peterson

*Attorney, Agent, or Firm*—Griffin, Butler Whisenhunt & Kurtossy

[57] ABSTRACT

A machining head for a water jet cutting machine as well as an aiming device equipping such head, includes:

an interchangeable tip (28) coupled to a feed source (A) of water under pressure, an acceleration nozzle (22) fixed to the casing (2) and connected to the interchangeable tip (28), a cutting pipe (60) receiving a water jet (J) emitted by the nozzle (22), and a pipe carrier (62) maintaining the pipe (60) relative to the casing (2), such head being characterized in that it includes regulating means (120*a*, 120*b*, 112, 94*a*, 94*b*) which permit regulation of the position of the pipe carrier (62) relative to the casing (2) in order to adjust the orientation of the pipe (60) in a manner coaxial to the jet (J) emitted by the nozzle (22).

28 Claims, 5 Drawing Sheets

MACHINING HEAD FOR A WATER JET CUTTING MACHINE AND AIMING DEVICE INTENDED TO EQUIP SUCH HEAD

The present invention concerns a machining head referred to as VHP (very high pressure, namely about 4000 bars) for a water jet cutting machine intended for high precision machining. More specifically, this invention concerns a machining head including regulating means permitting the adjustment in a systematic and repetitive fashion of the direction of the water jet within the interior of such head.

Additionally, the invention concerns an aiming device intended to equip a head including the above mentioned means.

Machining heads intended to equip water jet cutting machines typically include a casing or mounting which is intended to be fixedly mounted on an "XY" orientation table or on an articulated robot mounted on a carriage.

Within such head is housed in addition an acceleration nozzle which is fixed to the casing and which is connected by appropriate piping, to a feed source furnishing water possibly with additives, at very high pressures.

The acceleration nozzle has as function to bring the water which it receives from admission means to a very high velocity, in particular supersonic, in order to form a coherent water jet capable of perforating in a well-defined and precise fashion any material whatsoever in a part to be machined.

To this effect, the acceleration nozzle includes at its output a suitably perforated regulating tip formed of very hard material such as sapphire or corundum.

Furthermore, the machining head includes at its output a cutting pipe mounted in the head facing the acceleration nozzle, that is to say downstream from the regulating tip in the interior of a pipe carrier housed in the casing. Additionally, a supply tube for an abrasive is placed between the output of said nozzle and said pipe.

The pipe thus receives the water jet emitted by the acceleration nozzle as well as the abrasive agent which it must guide towards the part to be cut.

Consequently, the cutting pipe must be arranged in a manner perfectly coaxial relative to the water jet.

It is thus understood that any alignment defect between the water jet emitted by the nozzle and the pipe will bring about whistling and, if such defect is not corrected prior to the machining operation, premature wear of the pipe.

It is thus necessary to furnish regulating means capable of assuring the adjustment of such water jet, discharged in an "accelerated" fashion and under very high pressure relative to the pipe.

Thus, the present invention has as purpose to furnish a machining head including regulating means which are capable of assuring the perfect orientation of the water jet emitted by the acceleration nozzle relative to the cutting pipe and which is of a simple conception, sturdy, while being capable of assuring rapid, repetitive and reliable regulation of such orientation.

The present invention has also as purpose to furnish an aiming device capable of equipping such a head.

To this effect, the present invention has as object a machining head for a water jet cutting machine, comprising:

- a casing intended to be fixedly mounted on the cutting machine,
- admission means intended to be coupled to a feed source of water under pressure,
- an acceleration nozzle fixed to the casing and connected to the admission means, such nozzle being intended to form a jet of water at high velocity, suitable to effect cutting of a material,
- a cutting pipe arranged to receive the water jet emitted by the acceleration nozzle, and
- a pipe carrier maintaining the cutting pipe in position relative to the casing, such head being characterized in that it includes regulating means which permit regulation of the position of the pipe carrier relative to the casing in order to adjust the orientation of the cutting pipe in a fashion coaxial to the jet emitted by the nozzle.

Thus, it will be understood that, thanks to this characteristic, the acceleration nozzle can be provided fixed relative to the casing which simplifies considerably the overall conception of the head according to the invention and assures its sturdiness. This characteristic also permits assuring, in a simple fashion, the centering of the regulating tip, in particular by the agency of a tube which forms part of such acceleration nozzle and which is fixedly mounted relative to the casing.

According to another characteristic of the invention, the regulating means comprise furthermore an aiming device including a target housed in a support arranged to be able to be mounted on the pipe carrier.

More specifically, such support is formed so as to come to be positioned in the pipe carrier in the place of the cutting pipe.

From this fact, it is understood there also that the regulation effected can be trustworthy and repetitive since the position of the regulating pipe, into its adjusted position, in being effected instead and in place of the cutting pipe, corresponds exactly to the position which such cutting pipe should occupy during the machining, that is to say, at the time of passage through the latter of the jet emitted by the acceleration nozzle.

The present invention has also as object an aiming device intended to equip the machining head mentioned above characterized in that it includes a support provided with a detachable target and with a regulating pipe formed so as to come to be housed in the pipe carrier in the place of the cutting pipe.

Other characteristics and advantages of the present invention will appear more clearly upon reading of the detailed description which follows, taken with reference to the attached drawings which are given solely by way of example and in which.

Figure 1:
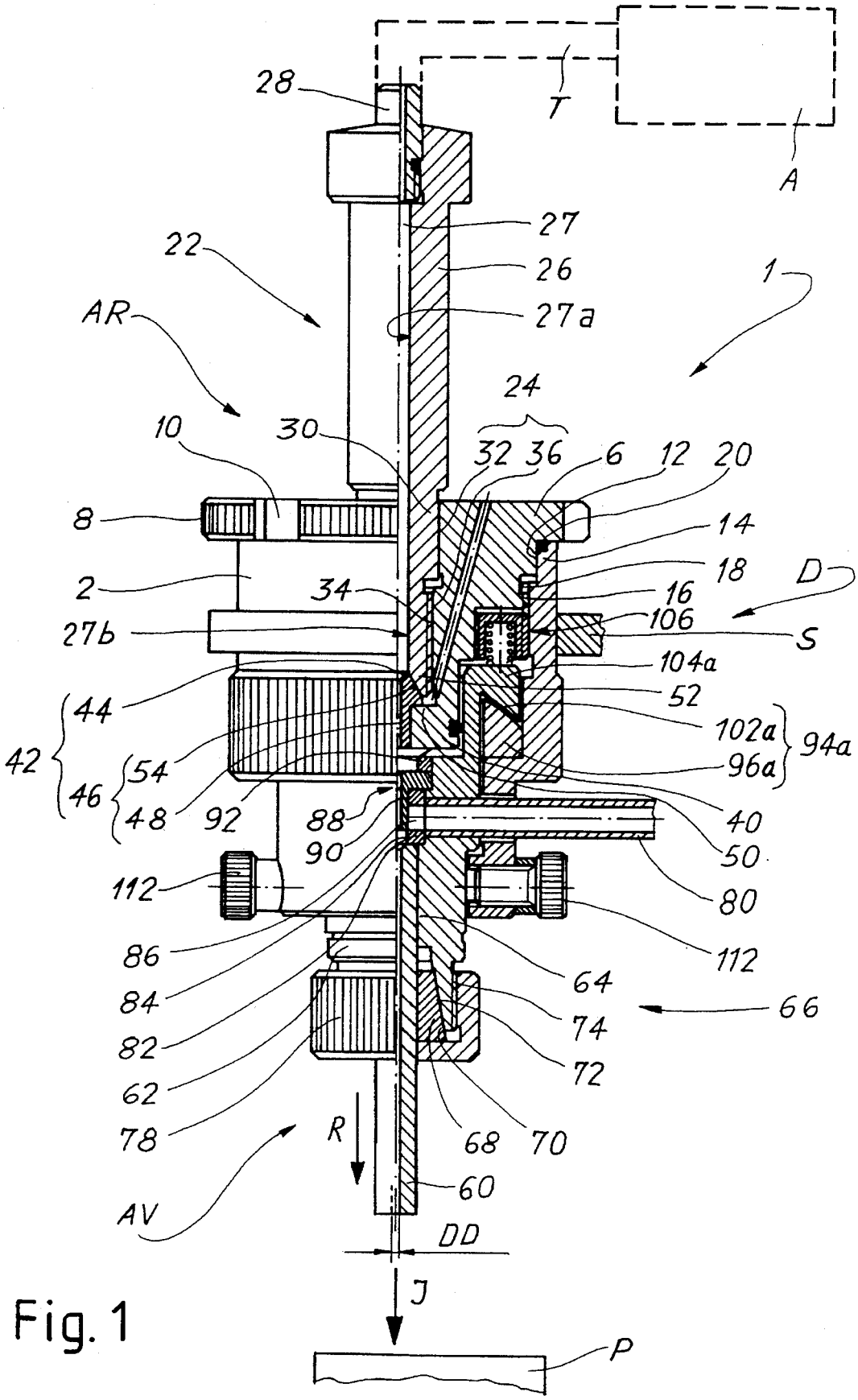
FIGS. 1 and 3 are half-views in longitudinal cross-section of a machining head, respectively according to a first and a second embodiment of the invention, such head being shown in its configuration at the time of cutting of a part shown here in schematic fashion.

Referring henceforth to FIG. 1, there will be described hereinafter a first embodiment of a machining head according to the invention, identified by the general reference 1 and shown in its configuration ready for machining of the material of a part P shown on FIG. 1 in a very schematic fashion.

Machining head 1 includes a casing 2 which is intended to be fixedly mounted on a support S of a cutting machine D, both here shown in a partial fashion and very schematic fashion. Casing 2 which opens out axially at its two ends shows a generally tubular basically cylindrical form which is stepped on the interior as well as the exterior.

As has been specified previously, casing 2 can be directly mounted on a support formed by a machining table displaceable according to several axes, in particular "XY", or on a support formed by an articulated robot mounted on a carriage.

It is understood by fixed mounting of casing 2 on the cutting machine D, a relative maintaining in place of casing 2 with reference to support S which is sufficiently rigid and stable to assure the correct and continuous positioning of a water jet J emitted by head 1 relative to the part P during the machining work and in particular during displacement of support S. As is well understood, casing 2 can be mounted in a detachable fashion on support S and this for reasons of interchangeability and of maintenance.

Head 1 is coupled to a feed source of water under pressure referenced A through the agency of piping T, shown on FIGS. 1 to 4 in a schematic fashion in broken lines.

There will henceforth be described more specifically the structure of head 1 according to the invention in taking as reference the run off sense of water jet J shown by arrow R in order to define the terms "upstream" and "downstream". As to the terms "upper" and "lower", these are defined in taking as reference head 1 in its position shown on FIG. 1. Finally, the term "back" designates the regions or elements of head 1 the closest to the input of water under pressure furnished by the feed source A, the term "forward" designating the regions or elements the closest to the output of the water jet J.

The head 1 according to the invention includes in its back portion AR a stepped connecting nut 6 of basically cylindrical form which is housed and held in an extremely precise position and in a fixed fashion within casing 2.

Figure 2:
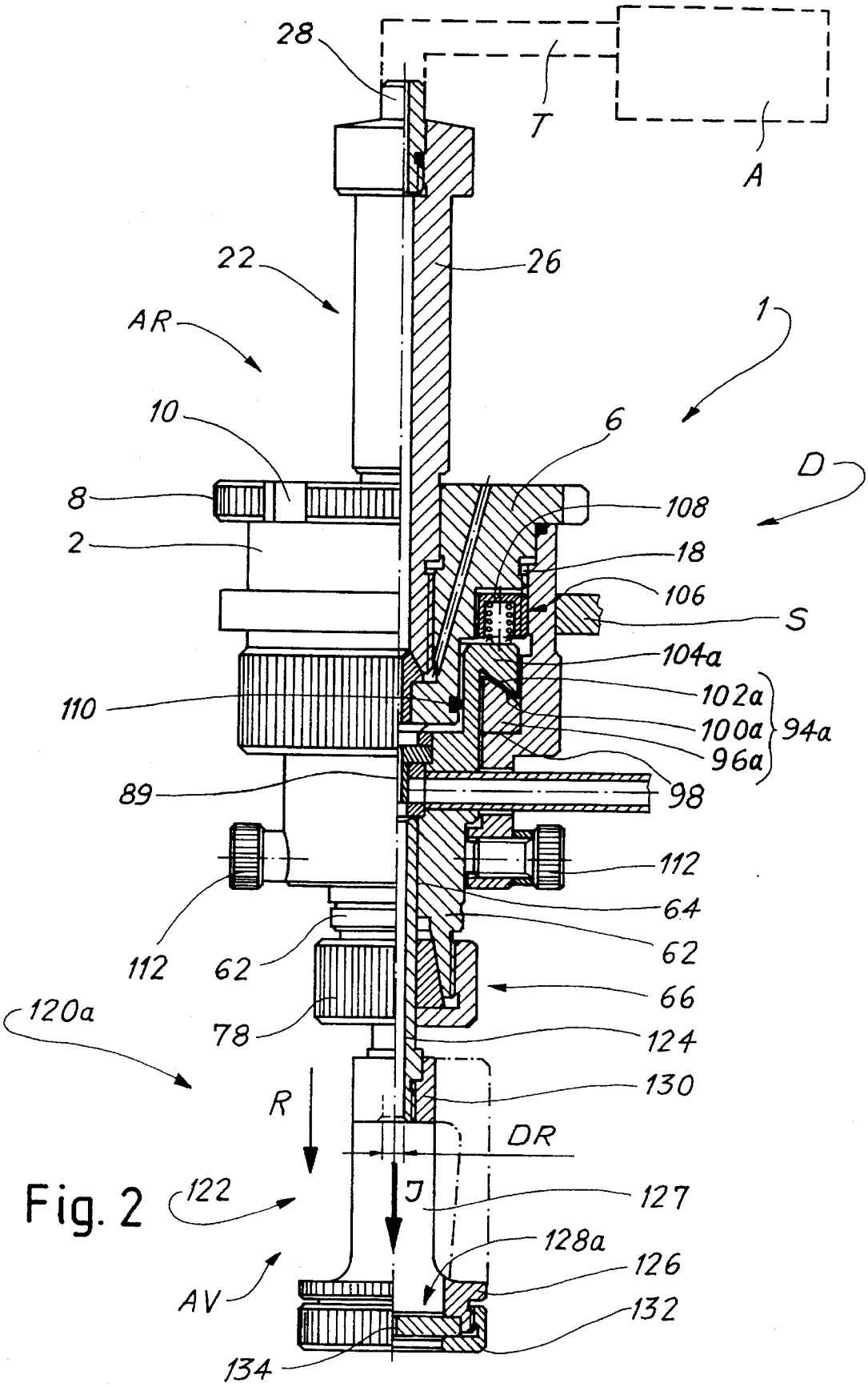
FIGS. 2 and 4 are views similar to FIGS. 1 and 3, but show respectively the machining head according to the invention provided with an aiming device according to a first and a second embodiment during the operation of regulation of the water jet emitted by an acceleration nozzle fixedly arranged in such head, such aiming device being furthermore shown from the side in broken outline.
Figure 3:
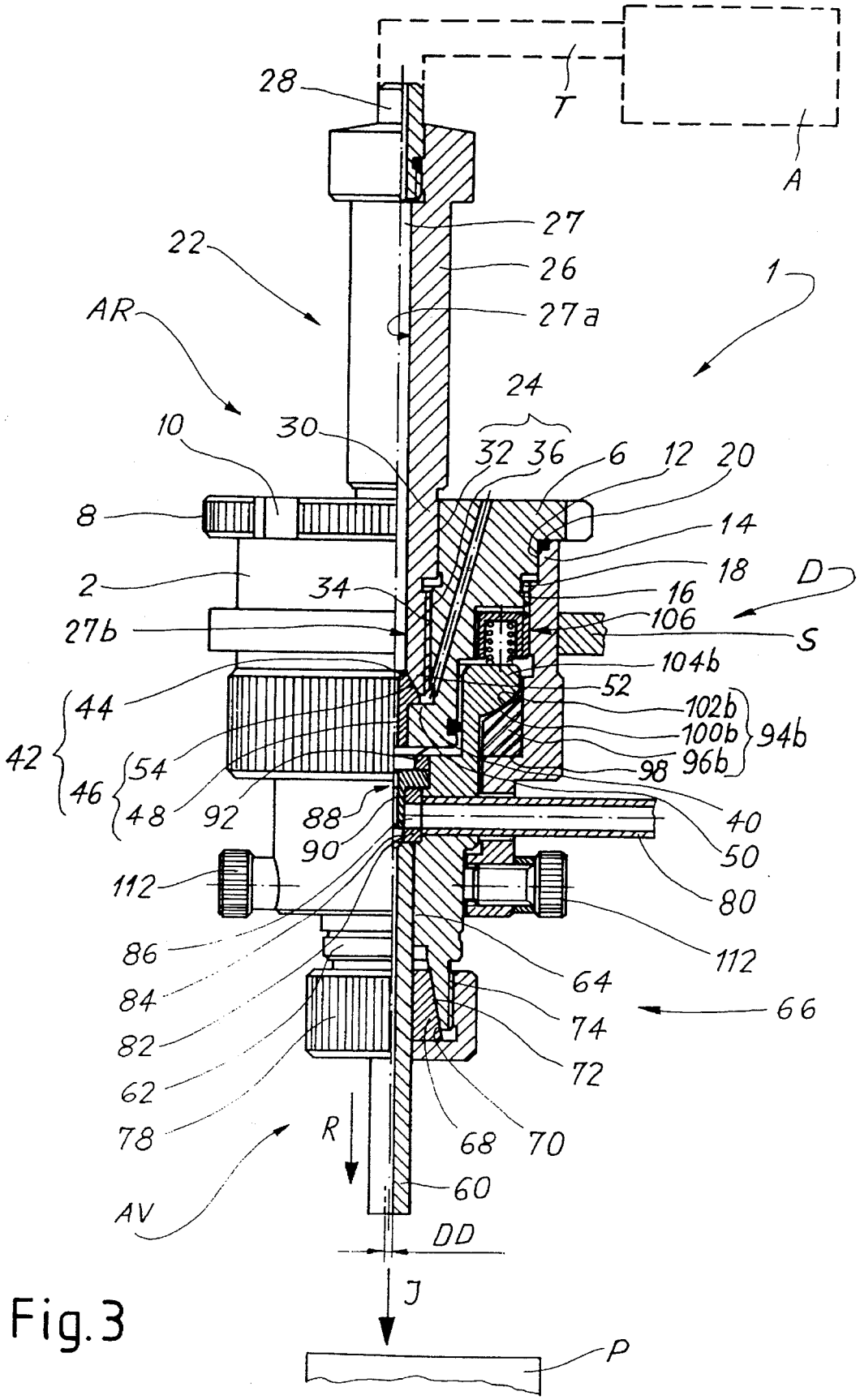

To this effect, in the back portion of the connecting nut 6 is formed a grasping collar 8 of which the outer periphery which has been deformed, for example by milling, includes several outer notches 10 (for example four in number, two alone among them being shown on FIGS. 1 and 2) formed here in a fashion opening out radially in order to permit, with the help of a tool, not shown, the firm tightening of the coupling nut 6 within the interior of casing 2. The coupling nut 6 includes in this region a basically cylindrical bearing portion 12 formed in the neighbourhood of the grasping collar 8, downstream of the latter.

Casing 2 also includes in its back portion, not referenced, a positioning bore 14 which opens out to the exterior and which receives by a sliding adjustment the cylindrical bearing surface 12 of the coupling nut 6.

Such adjustment assures precise positioning and perfect coaxiality of the assembly between the coupling nut 6 and casing 2.

Furthermore, the coupling nut 6 includes, likewise in its back portion, screw threading 16 which is formed in a fashion adjacent the cylindrical bearing surface 12 and which is engaged in a corresponding internal threading 18 formed in casing 2 in the extension of its positioning bore 14.

The coupling screw-nut between screw thread 16 and internal thread 18 assures the fixed maintenance and jamming in position of the coupling nut 6 relative to casing 2.

It will be noted to this effect that the grasping collar 8, in its assembled position shown on FIGS. 1 and 2, rests in axial bearing at the end on the back end, not referenced, of casing 2 and compresses a seal 20 of the toroidal seal type (called under the British terminology "O" ring) housed in the back open end, not referenced, of casing 2.

This seal 20 assures water tightness of head 1 and protects the regulating means housed in the head 1, which means will be described hereinafter in a detailed fashion.

Head 1 additionally includes an acceleration nozzle 22 which is borne by nut 6 in being mounted in a manner coaxial to the latter. More specifically, the acceleration nozzle 22 is positioned and fixedly held in a housing 24 formed in nut 6.

The acceleration nozzle 22 includes a cylindrical sleeve 26 of generally elongated form at the back of which is mounted an interchangeable tip or valve seat 28 assuring the connection of head 1 to the piping T and consequently constituting admission means intended to be coupled to the feed source of water under pressure A.

The elongated sleeve 26 includes, formed at its forward portion, not referenced, a cylindrical bearing surface 30 engaged by sliding adjustment in a positioning bore 32 formed in nut 6 at the back of the latter. The sleeve 26 further includes, downstream of the bearing surface 30, screw threading 34 engaged with an internal thread 36 formed in the nut 6 neighbouring the bore 32. The bore 32 forms partially, together with the internal thread 36, the housing 24 arranged in nut 6.

The sleeve 26 includes an interior conduit 27 intended to receive water under pressure (not shown) from the detachable tip 28. Conduit 27 shows in its upstream portion directly under tip 28 a first region **27*a*, preferably of tapered form (about 2%), narrowing down towards the forward portion followed by a second region 27*b*, also preferably tapered (about 2%) but this time opening out towards a regulating nozzle 42. This arrangement forms internal cohesion means of the flow of water within the sleeve 26 and assures formation of a water jet called "coherent" at the output of the acceleration nozzle 22** during the regulation which will be described hereinafter, which regulation is effected with feeding water at low pressure.

Nut 6 in other respects includes, at its forward end, not referenced, an interior reentrant collar 40 on which rests axially the regulating nozzle 42. Such regulating nozzle 42 includes a regulating tip 44 which is maintained in a seat 46 also forming part of the nozzle 42.

The regulating tip 44, which is here represented in a schematic fashion, is formed of hard material such as sapphire or corundum and it includes a central orifice, not shown, capable of forming a very fine thread of water capable of constituting an appropriate cutting jet J called "coherent" jet.

The seat 46 includes a cylindrical skirt 48 which is housed with radial play in the reentrant collar 40 which exhibits a shoulder 50 formed in housing 24.

Seat 46 rests in axial bearing on shoulder 50 by a corresponding shoulder, not referenced.

In other respects, the acceleration sleeve 26 includes at its forward end in a manner contiguous to region **27*b*, a tightening cavity 52 formed at the end and opening out towards the exterior of sleeve 26. The tightening cavity 52 exhibits a tapered or partially spherical form and it rests on a tapered periphery 54 exteriorly formed on seat 46 of the regulating nozzle 42. It is thus understood that during putting into place and during the tightening of sleeve 26 in nut 6, the regulating nozzle 42 which has been previously freely positioned in collar 40 of nut 6 is found to be self-centered by the tightening cavity 52 and by its outer tapered periphery 54**.

Thus, it follows from this arrangement that the acceleration nozzle 22 which includes the sleeve 26, the tip 28 and the regulating nozzle 42 is positioned in a precise fashion and rigidly relative to casing 2. In thus being fixed rigidly to casing 2, the acceleration nozzle 22 can form a water jet J exhibiting a perfectly stable position relative to support S, whatever be the motions of machine D.

The head 1 according to the invention further includes in its forward portion AV, a cutting pipe 60 which is supported and maintained by a pipe carrier 62 on the interior of the latter, such pipe carrier 62 being itself housed in the interior of casing 2.

The cutting pipe 60 is arranged in head 1 in coincidence with the output of the acceleration nozzle 22 in order to receive downstream the water jet emitted by such nozzle.

Pipe 60 is precisely positioned relative to the pipe carrier 62 thanks to its engagement in a positioning bore 64 formed in the forward portion, not referenced, of the pipe carrier 62. In other respects, the maintenance in fixed position of pipe 60 is assured by a clamp 66 arranged forwardly of the pipe carrier 62 and including a jamming sleeve 68 formed of elastomeric material.

The jamming sleeve 68 includes a tapered outer periphery 70 cooperating with a tightening cone 72 formed at the forward end, not referenced, of the pipe carrier 62. The tightening cone 72 is flared towards the exterior and forwardly and it is formed on a wall of the pipe carrier 62 which exhibits an outer threading 74 on which is engaged an interiorly threaded ring 78 in axial bearing on the jamming sleeve 68.

The pipe carrier 62 in other respects includes a tube 80 for supplying an abrasive, not shown, such tube 80, which is radially engaged in the pipe carrier 62, being force mounted in the latter, in particular by driving in.

Tube 80 opens out in the pipe carrier 62 in a mixing chamber 82 formed in the latter. The mixing chamber 82 includes an annular ring 84 perforated radially which is also driven into the pipe carrier 62 in a fashion coaxial to the latter and which includes a radial opening 86 arranged facing tube 80 in order to receive the abrasive furnished by the latter and to transmit it towards the cutting pipe 60.

The mixing chamber 82 further includes a deflector 88 which rests axially on the lateral edge of ring 84 and which includes an elastic skirt 90 obstructing the output from opening 86 in order to prevent any untimely return of the abrasive agent towards the acceleration nozzle 22. Such deflector 88 includes a central bore 89.

In an advantageous fashion, trials which have been effected on deflector 88 have shown that a dimensioning of its bore 89 to a diameter of 0.8 mm ($0.8.10^{-3}$ meters) could prevent during operation of the machining head 1, all abrasive return (brought by tube 80) upstream and in particular towards the regulation nozzle 46.

This anti-backflow protection function furnished by deflector 88 prevents destruction of the tip of hard material 44 which, in known dimensions, is subject to rapid wear.

Figure 4:
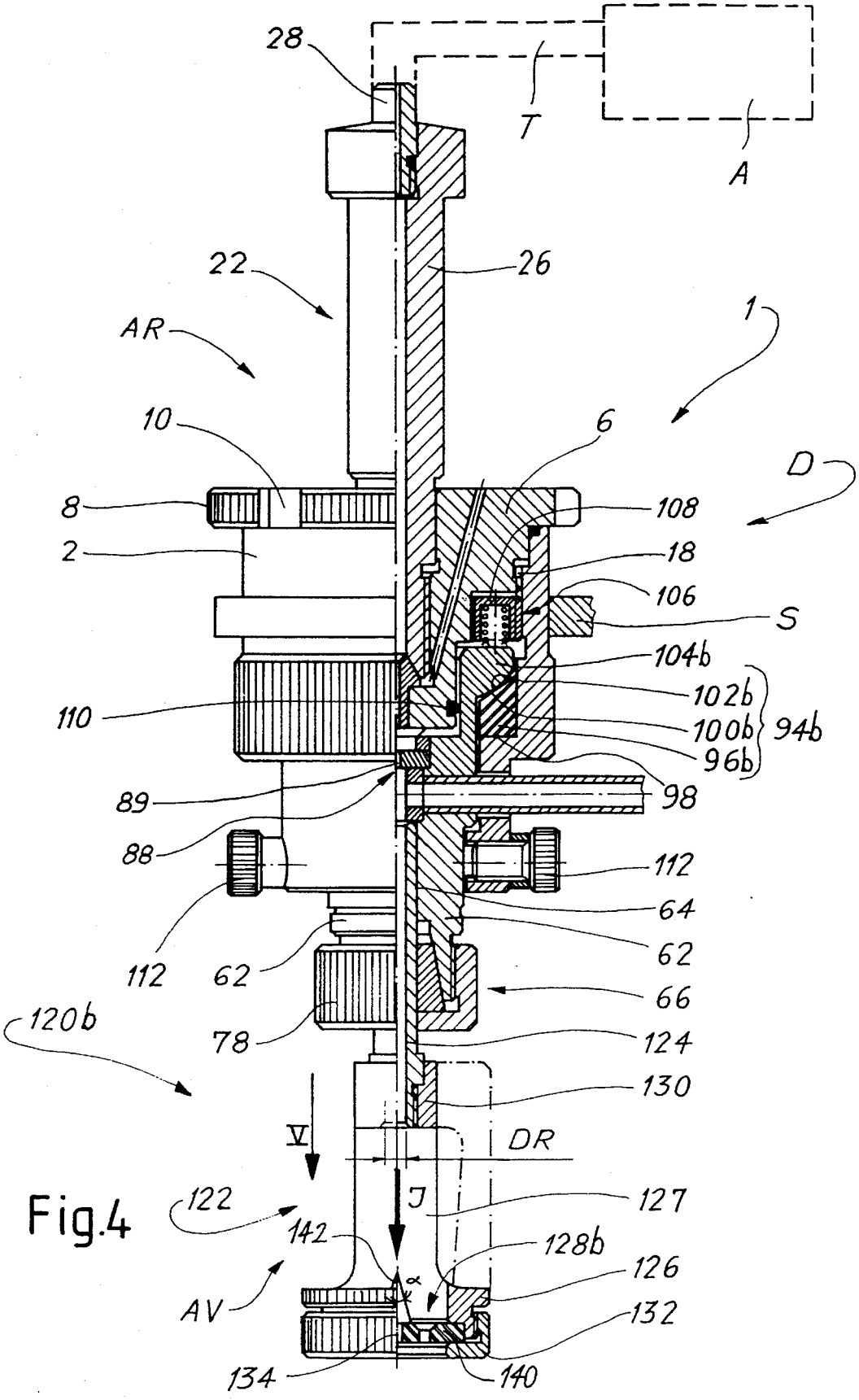

Here it will be specified that, as shown on FIG. 4, such anti-backflow protection function is also produced when skirt 90 of deflector 88 is omitted. Moreover, in a variant of the embodiment, not shown, the deflector 88 thus dimensioned can be secured to the regulation nozzle 42 in being arranged forward of the latter, for example by force fitting of appropriate forms (not shown), or by gluing.

The mixing chamber 82 is closed in its back portion by a lip seal 92 resting laterally on the deflector 88 and the lip of which rubs against the forward free end of nut 6 at the output of the acceleration nozzle 22.

Here it will be specified that such seal 92 assures water tightness of the articulation means which will be described hereinafter and which permit, during an operation of regulation of the water jet J, pivoting of the pipe carrier 62 relative to the acceleration nozzle 22 while this latter, as has been explained hereinbefore, is fixedly mounted with reference to the casing 2.

The articulation means according to the invention are constituted in both embodiments described by a swivel joint or spheric pair 94*a*, 94*b* arranged between the pipe carrier 62 and the casing 2.

In the two embodiments according to the invention, the spheric pair 94*a*, 94*b* is constituted by an annular ring 96*a*, 96*b* which is housed in the casing and which, as will be understood, forms a seat supporting and surrounding the pipe carrier 62. As to such ring 96*a*, 96*b*, it is supported by the casing 2 in axial bearing against a shoulder 98 (see FIGS. 2 and 4) formed in the latter, and it exhibits at the back a partially spherical 100*a* or tapered 100*b* bearing surface, on which rests directly a bearing portion 102*a*, 102*b* formed on the pipe carrier 62.

The bearing portion 102*a* in the first embodiment (FIGS. 1 and 2) exhibits a reentrant tapered form opening out forwardly while the bearing portion 102*b* of the second embodiment (FIGS. 3 and 4) exhibits a semi-circular or convex form opening out towards the back. It will be specified that in this embodiment the spheric pair 94*b* is formed in order that its pivoting center (not shown) coincides with the orifice of the regulating tip 44. Each bearing portion is arranged on a collar 104*a*, 104*b* which is formed in the neighbourhood of an end, not referenced, of the pipe carrier at the back of the latter. The collar 104*a*, 104*b* is axially urged onto ring 96*a*, 96*b* forming the seat by the agency of elastic means 106.

The elastic means 106 are formed by compression springs (same reference) housed in an annular ring 108 (see FIG. 2) called thrust ring attached to the interior of casing 2. Ring 108 which is threaded exteriorly is screwed into the casing 2 in being engaged in its internal threading 18. It will be noted that the thrust ring 108 is mounted in the casing 2 around the coupling nut 6, but with radial play and with axial play relative to the latter.

The axial position of the ring 108 in casing 2 can be regulated independently of the position of nut 6 in order to adjust the elastic pressure of the compression spring 106 on the back of the collar 104*a*, 104*b*. For that ring 108 includes gripping orifices, not shown, formed in order to receive a regulating tool likewise not shown.

It will be noted that the forward end of the coupling nut 6 thrusts into the rear opened-out portion of the pipe carrier 62 in a fashion coaxial to the latter and with sufficient radial play in order to permit pivoting of the pipe carrier 62 in casing 2.

The nut 6 includes in other respects at its forward end a seal 110 (see FIG. 2) of the toroidal seal type in radial bearing on the pipe carrier 62.

The adjusting means according to the invention additionally include screws 112 (in particular four in number, separated by 90°, two only among them being here shown) which permit the jamming of the pipe carrier 62 in a fixed position relative to casing 2.

Screws 112 are mounted in casing 2, forwardly of the latter, and they act radially on the outer periphery of the pipe carrier 62.

The regulation means according to the invention further comprise an aiming device according to two embodiments (FIGS. 2, 4 and 5) which include a support 122 arranged to be capable of attachment in the pipe carrier 62. Such support 122 is shown in a face view in full lines and, on FIGS. 2 and 4, it is also seen schematically from the side in broken lines.

The aiming device 120*a*, 120*b* (and more specifically its support 122) includes a regulating pipe 124 which is intended as is seen on FIG. 2, to come to be housed in the pipe carrier 62 in the place of the cutting pipe 60 in bore 64.

It will be observed nevertheless that such regulating pipe 124 exhibits an inner diameter DR greater than the inner diameter DD (FIG. 1) of the cutting pipe 60. The water jet J can thus traverse the regulating pipe 124 without touching the internal wall of the latter and without being disturbed during the operation of regulation.

Support 122 is formed by a part in "C" form one branch 126 of which forms a seat in which is housed a target 128*a*, 128*b*, while another branch 130 bears the regulating pipe 124 which is oriented in a manner normal to target 128*a*, 128*b*. The two branches 126 and 130 are coupled by a third 127 called coupling branch.

According to the first embodiment shown on FIG. 2, target 128*a* is basically constituted by an interchangeable pellet of planar form mounted in a detachable fashion in support 122 and more specifically in branch 126. To this effect, branch 126 which is basically circular includes a nut 132 which assures blocking of target 128*a*. The pellet forming the target 128*a* includes a central orifice 134 in the direction of which the water jet J is pointed during regulation. Thanks to the perforated structure of the support 122, an operator can, during regulation, observe on practically all the sides (over about 300°) the impact of the water jet J supplied at low pressure, but in a coherent fashion, thanks to sleeve 26, on the target 128*a*.

Figure 5:
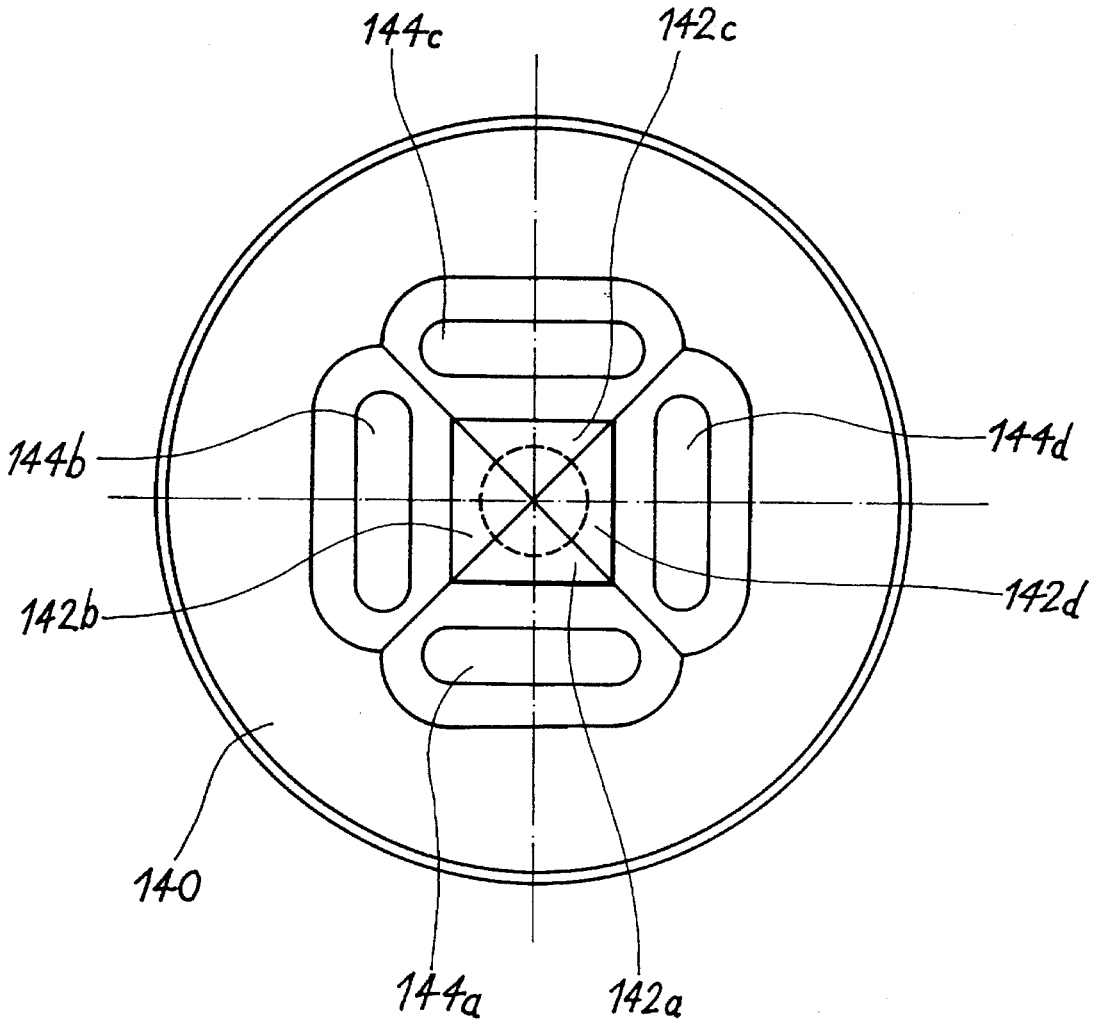

In referring henceforth more specifically to FIGS. 4 and 5, there will be described hereinafter an aiming device 120*b* according to a second embodiment of the invention. Such aiming device 120*b* differs from the device 120*a* by its target 128*b* which, although mounted in an identical fashion in the support 122, exhibits relative to target 128 a structure permitting an even easier and finer regulation.

In effect, target 128*b* includes a seat 140 likewise maintained in branch 126 by nut 132, but from which rises in its center an indicator 142 of pyramidal form oriented towards the back of head 1, that is to say, towards the output of the regulating pipe 124. The indicator 142 is force fitted into the seat 140. It includes four planar convergent faces 142*a* to 142*d* (FIG. 5) inclined at an angle $\alpha$ of about 10° relative to the output direction of the water jet J and thus relative to the longitudinal geometric axis of the aiming device 120*b*.

About the pyramidal indicator 142 are arranged in seat 140 four oblong hollows 144*a* to 144*d* oriented parallel to the bases of indicator 142, as well as in the extension of such four faces 142*a* to 142*d*.

Such four hollows 144*a* to 144*d* respectively have a form of basin opening out at the input, and they are open towards the water jet J. It will be here specified that the four hollows 144*a* to 144*d* are all calibrated to the same dimension. Seat 140 is for example formed of aluminium while the indicator 142 is formed in a hard material such as tungsten carbide.

The process of regulating the head according to the invention is the following:

Initially, the clamp 66 is loosened in order to liberate the cutting pipe 60 which is taken out of the pipe carrier 62.

In the place of the cutting pipe 60 there is inserted in pipe carrier 62 the support 122 by introducing the regulating pipe 124 in bore 64.

After having blocked the regulating pipe 124 thanks to clamp 66, the screws 112 are loosened in order to permit the pipe carrier 62 and the aiming device 120*a*, 120*b* to pivot relative to casing 2 by the agency of the spheric pair 94*a*, 94*b*.

The water being furnished by the feed source A at low pressure, a coherent water jet J, thanks to the form of conduit 27 of sleeve 26, is formed at the output of the regulating pipe and comes to hit the target 128*a*, 128*b*. The aiming device 120*a*, 120*b* is then manually displaced by the operator, not shown, by causing the pipe carrier 62 to pivot relative to casing 2.

In making use of the arrangement 120*a* (FIG. 2) the pipe carrier 62 is blocked thanks to screws 112 when the water jet J is placed in coincidence with orifice 134.

As to the aiming device 120*b* (FIG. 4), the operator, after having opened the low pressure water feed source, displaces the pyramidal indicator 142 until its point is found perfectly under the water jet J and that four identical water packets, not shown, are formed at the output of the four calibrated hollows of seat 140 under the aiming device 120*b*. Any difference whatsoever of form in one of the packets at the output of the device indicates to the operator an error of regulation and the sense in which he must displace the pipe carrier 62.

The regulation operation terminated, the aiming device is released by loosening clamp 66, then removed. Next, the cutting pipe 60 is repositioned in the pipe carrier 62, which henceforth is arranged in a manner perfectly coaxial to the working jet J.

I claim:

1. Machining head for a water jet cutting machine, including:

a casing (2) adapted to be fixedly mounted on the cutting machine (D), admission means (28) adapted to be coupled to a feed source (A) of water under pressure, an acceleration nozzle (22) fixed to the casing (2) and connected to the admission means (28), said nozzle (22) being intended to form a jet (J) of water at high velocity, suitable to effect cutting of a material, a cutting pipe (60) arranged to receive the water jet (J) emitted by the acceleration nozzle (22), and a pipe carrier (62) maintaining the cutting pipe (60) in position relative to the casing (2), regulating means (120*a*, 120*b*, 112, 94*a*, 94*b*) which permit regulation of the position of the pipe carrier (62) relative to the casing (2) in order to adjust the orientation of the cutting pipe (60) in a manner coaxial to the jet (J) emitted by the nozzle (22), characterized in that said regulating means comprise an aiming device 120*a*, 120*b*) including a target (128*a*, 128*b*) mounted to a support (122) arranged so as to be able to be mounted in said pipe carrier (62).

2. Machining head according to claim 1, characterized in that the target (128*a*, 128*b*) is housed in said support (122).

3. Machining head according to claim 1 characterized in that said support (122) is formed in order to come to be positioned in the pipe carrier (62) in place of the cutting pipe (60).

4. Machining head according to claim 3, characterized in that said support (122) includes a regulating pipe (124) arranged to be housed in the pipe carrier (62) in place of the cutting pipe (60), said regulating pipe (124) being of an interior diameter (DR) greater than that (DP) of the cutting pipe (60).

5. Machining head according to claim 4, characterized in that said support (122) is formed by a piece in "C" form, a branch (126) of which forms a seat in which the target (128*a*, 128*b*) is housed while another branch bears the regulating pipe (124).

6. Machining head according to claim 1, characterized in that said target (128*b*) is constituted by a marker (142) of pyramidal form supported by a seat (140) mounted to said support (122) and in which seat are formed four hollows (144*a* to 144*d*) arranged about the marker (142).

7. Machining head according to claim 6, characterized in that said seat (140) is assembled in a detachable manner in said support (122).

8. Machining head according to claim 7 characterized in that the articulation means are constituted by a swivel joint arranged between the pipe carrier (62) and said casing (2), said swivel joint being constituted by a ring (96*a*, 96*b*) forming a seat, surrounding the pipe carrier (62), said ring (96*a*, 96*b*), which is supported by the casing (2), exhibiting a support surface (100*a*, 100*b*) on which rests a bearing portion (102*a*, 102*b*) formed on the pipe carrier (62).

9. Machining head according to claim 8, characterized in that said bearing portion (102*a*, 102*b*) is formed on a collar (104*a*, 104*b*) arranged in the neighbourhood of an end of the pipe carrier (62), such collar (104*a*, 104*b*) being axially urged onto the ring (96*a*, 96*b*) forming a seat through the agency of elastic means (106).

10. Machining head according to claim 9, characterized in that the elastic means (106) are formed by compression springs housed in a ring (108) of the so-called thrust type mounted on the interior of the casing (2).

11. Aiming device according to claim 7, characterized in that said seat (140) is formed of aluminum.

12. Aiming device arranged to be used with a machining head in accordance with claim 1, characterized in that it includes said support (122) provided with a target (128*a*, 128*b*), said support (122) being arranged so as to be able to be mounted in said pipe carrier (62 ).

13. Aiming device according to claim 12, characterized in that said target is removable.

14. Aiming device according to claim 12, characterized in that said target (128*a*, 128*b*) is housed in said support (122).

15. Aiming device according to claim 12, characterized in that the target (128*b*) is constituted by a marker (142) of pyramidal form supported by a seat (140) mounted to said support (122) and in which seat are formed four hollows (144*a* to 144*d*) arranged about the marker (142).

16. Aiming device according to claim 15, characterized in that said seat (140) is housed in said support (122).

17. Aiming device according to claim 15, characterized in that said seat (140) is mounted in a detachable manner in said support (122).

18. Aiming device according to claim 15, characterized in that said marker (142) is force fitted into said seat (140).

19. Aiming device according to claim 15, characterized in that said four hollows (144*a* to 144*d*) are oriented parallel to a base of said marker (142).

20. Aiming device according to claim 19, characterized in that said four hollows (144*a* to 144*d*) are positioned respectively in the extension of four planar convergent faces (142*a* to 142*d*) of the marker.

21. Aiming device according to claim 15, characterized in that said four hollows (144*a* to 144*d*) are all calibrated to the same dimension.

22. Aiming device according to claim 15, characterized in that said marker (142) is formed in tungsten carbide.

23. Aiming device according to claim 12, characterized in that said support (122) is formed so as to come to be housed in the pipe carrier (62) in place of the cutting pipe (60).

24. Aiming device according to claim 23, characterized in that said support (122) includes a regulating pipe (124) arranged to be housed in the pipe carrier (62) in place of the cutting pipe (60).

25. Aiming device according to claim 24, characterized in that said seat (140) is maintained in said support by a nut (132).

26. Aiming device according to claim 24, characterized in that said regulating pipe (124) has an interior diameter (DR) greater than the interior diameter (DD) of the cutting pipe (60).

27. Aiming device according to claim 24, characterized in that said support (122) exhibits an open work "C" structure including several branches, one (130) of which supports the regulating pipe (124) while the other (126) supports the target (128*a*, 128*b*).

28. Aiming device according to claim 23, characterized in that said support (122) includes a regulating pipe (124) arranged to be housed in the pipe carrier (62) in place of the cutting pipe (60), and said target (128*b*) comprises a marker of pyramidal form oriented toward said regulating pipe (124) and supported by a seat (140) mounted to said support (122) and having four hollows (144*a*–144*d*) arranged about said marker (142).

* * * * *